United States Patent [19]

Jensen

[11] 4,160,650

[45] Jul. 10, 1979

[54] SAND CORE CLEANING APPARATUS WITH DOUBLE ROLLER DELIVERY OF CLEANING MATERIAL

[75] Inventor: Brian J. Jensen, Franksville, Wis.

[73] Assignee: NFE International, Ltd., Palatine, Ill.

[21] Appl. No.: 898,201

[22] Filed: Apr. 20, 1978

[51] Int. Cl.[2] ..... B24B 31/00; B24C 3/10

[52] U.S. Cl. ..... 51/16; 51/418; 51/425; 51/436

[58] Field of Search ..... 51/16, 317, 418, 425, 51/428, 436

[56] References Cited

U.S. PATENT DOCUMENTS

| | | | |
|---|---|---|---|
| 977,453 | 12/1910 | Jorn | 51/428 |
| 1,867,856 | 7/1932 | McCrery | 51/418 |
| 2,332,251 | 10/1943 | Parrish | 51/418 |
| 2,925,689 | 2/1960 | Peterson | 51/16 X |
| 3,694,964 | 10/1972 | Bowling | 51/425 |
| 3,824,739 | 7/1974 | Moret | 51/418 |
| 3,921,336 | 11/1975 | Nishio | 51/418 |
| 3,934,373 | 1/1976 | Leliaert | 51/425 |

*Primary Examiner*—Gary L. Smith

*Attorney, Agent, or Firm*—Merriam, Marshall & Bicknell

[57] ABSTRACT

A core cleaning material delivery unit for use in removing fins from foundry sand cores, including counter-rotating rollers rotatably engaging and defining a contact surface junction, means for feeding core cleaning material, such as metal shot or metal grit, above the junction, and means for rotating the rollers in opposite rotational directions away from the top of the contact surface junction to transport the shot or grit upwardly over each roller and deposit it as a double curtain of falling core cleaning material onto the sand cores. A core cleaning system utilizing the aforementioned core cleaning material delivery unit mounted to a frame and vertically adjustable with respect to a core conveyor to adjust the height of the falling curtains of core cleaning material onto the sand cores, and separator and loading means for separating the core cleaning material from loosened sand resulting from removal of the fins and for directing the core cleaning material to the contact surface junction at the top of the rollers.

11 Claims, 4 Drawing Figures

128
140
144
136
150
146
138
154
A
148
152
38
C
142
32
28
134
156
26
34
12
130
160
158
26
V
30
B
38
46
24
18
20
14
112
116
A
58
120
114
124
22
10
42
44
42
B
118
38
47
122
126
C

SAND CORE CLEANING APPARATUS WITH DOUBLE ROLLER DELIVERY OF CLEANING MATERIAL

This invention relates generally to apparatus for cleaning foundry sand cores and particularly to apparatus for removing undesired fins and other small extensions or protrusions from such cores.

BACKGROUND OF THE INVENTION

Sand cores as used for molding metal products are placed in casting cavities and openings to form passageways or hollow portions in the casting. Such cores are formed by combining sand and a binder substance, such as synthetic resins, in a core making machine having patterns or dies to shape the core. During the formation of such cores, small, fin-like extensions, known as "fins" or "flash" often develop along the junction between the core-making dies. These undesired fins must be removed or at least substantially reduced to such an extent that they do not impair the formation of the finished metal product during the casting process.

Until recently, removal of the undesired fins has been accomplished manually. That is, one would normally pick up a newly formed core and scrape the fins with a wire brush or a small rigid tool, such as a file or knife, to knock the fins off. This is not only time-consuming and costly, but the manual core handling often leads to the eventual destruction of a small percentage of cores due to dropping, too vigorous handling, or cracks induced during the fin knock-off procedure.

In a co-pending application Ser. No. 893,203, filed Apr. 4, 1978. of G. T. Dupre and T. M. DeMarco, entitled "Apparatus for Cleaning Sand Cores" and assigned to the same assignee herein, there is described a new and unique system for removing fins from sand cores by utilizing a falling curtain of metal shot or metal grit and including means for separating the cleaning material from the loosened sand to permit reuse of these particles. The system described therein includes a conveyor for transporting the sand cores during cleaning, means for delivering a falling curtain of metal shot or grit onto the moving sand cores to remove the undesired fins, and means at the end of the core conveyor for separating the shot or grit from the sand resulting from removal of the fins and for transferring the separated shot or grit to the delivery means above the core conveyor for reuse. While this unique core cleaning system operates entirely satisfactorily, it is now desired to provide an improved, more efficient core cleaning system of smaller size, with fewer components, and of less overall manufacturing cost. In particular, it is also desired to improve the shot or grit delivery apparatus of the prior system.

SUMMARY OF THE INVENTION

In accordance with the principles of the present invention there is provided an improved sand core cleaning system which includes a counter-rotating double roller unit for delivery of the shot or grit core cleaning material. The improved core cleaning material delivery unit comprises a pair of counter-rotating rollers mounted so as to be in rotatable engagement with each other above and extending substantially across a core conveyor. Core cleaning material, comprising metal shot or metal grit is fed to the junction between the rollers. As the rollers are operated in opposite rotational directions, the core cleaning material is transported upwardly by each roller and thereby enabled to fall from the rollers onto the cores in the form of a double curtain of cleaning material.

The improved core cleaning delivery unit in accordance with the present invention incorporates fewer components with an accompanying substantial reduction in weight and manufacturing costs compared to the core cleaning delivery system previously described. In addition, the present counter-rotating, double roller core cleaning material delivery unit is more compact and centralized. Therefore, the new delivery unit can be more readily adjusted vertically under a broader range of conditions than the prior shot conveyor delivery unit. Thus, the new unit can be more quickly adjusted to vary the falling height of the curtain with respect to the cores.

A significantly improved core cleaning system is provided by utilizing this improved core cleaning material delivery unit with a core conveyor, a separator at the end of the conveyor separating the core cleaning material and the loosened sand resulting from removal of the fins, and means for reloading the delivery unit with the separated core cleaning material. Compared to the previously described prior core cleaning system, the present core cleaning system utilizing the improved core cleaning delivery unit herein significantly reduces the overall length of the core conveyor and restricts the delivery or distribution of the core cleaning material to a generally central location over the core conveyor. In the core cleaning material delivery unit of the previously described system, the possibility of spillage of cleaning material is more difficult to control since the material is conveyed to the delivery unit at one end of the shot/grit conveyor and delivery or distribution of the cleaning material is accomplished at the other end of the shot/grit conveyor.

DETAILED DESCRIPTION

Figure 1:
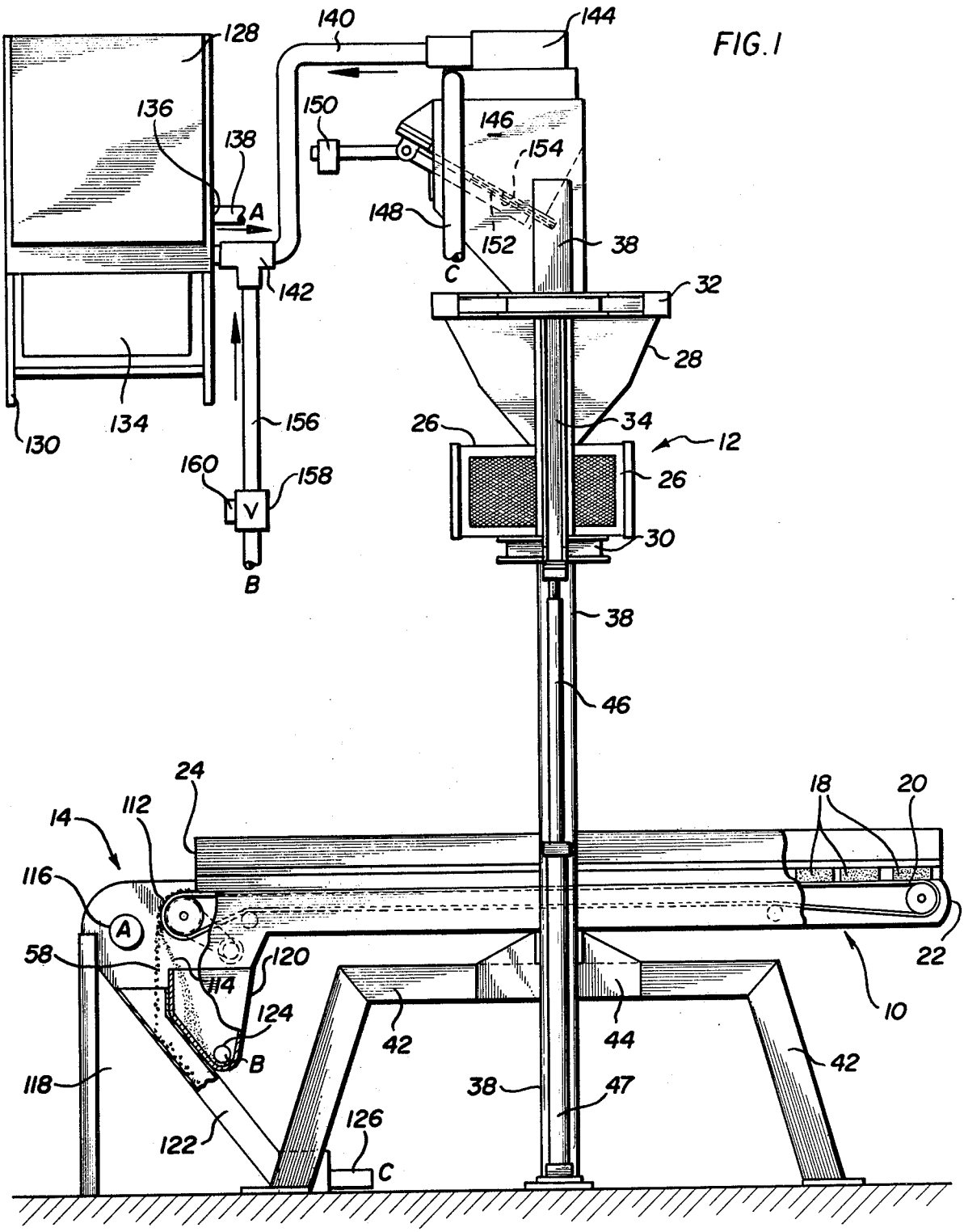
FIG. 1 is a partly side elevational view and a partly schematic view of an overall improved sand core cleaning apparatus utilizing an improved core cleaning material delivery unit in accordance with the principles of the present invention.

Referring now to FIG. 1, there is illustrated an improved sand core cleaning apparatus which includes generally, a core conveyor 10, a core cleaning material delivery unit 12 for removing undesired fins from the sand cores, a separator unit 14 at the discharge end of the core conveyor for separating the core cleaning material and sand resulting from the removed fins, and a loading unit 16 for reloading the delivery unit 12 with core cleaning material. Sand cores 18 having fins or other small protrusions which are to be removed are placed on the conveyor belt 20 at the core conveyor feed end 22. The cores 18 are transported by conveyor belt 20 from the feed end 22 to a core discharge end 24 of the core conveyor by means of a standard motor and pulley arrangement indicated in dashed lines for driving the conveyor belt 20. As the cores 18 pass under the core cleaning material delivery unit 12, they are subjected to a pair of falling curtains of core cleaning material, such as metal grit or metal shot for removing the fins.

The core cleaning material delivery unit 12 includes a counter-rotating pair of rollers mounted within an enclosure 26 and a core cleaning material feed hooper 28 for feeding the core cleaning material at the top junction between the rollers. Both the roller enclosure 26 and the feed hopper 28 are rigidly mounted in position with respect to each other by means of a rigid sub-frame assembly comprising a lower frame member 30, an upper frame member 32 and a pair of side frame members 34 and 36 rigidly interconnecting the lower and upper frame members. Both the lower frame member 30 and the upper frame member 32 are movably mounted to a pair of rigid support columns 38, 40. The columns 38 and 40, extend from ground level upwardly and on each side of the core conveyor 10, each being rigidly mounted to a platform 42. A bracket 44 on each side of the platform 42 is attached to the core conveyor 10 so as to maintain the core conveyor fixed in position.

Figure 2:
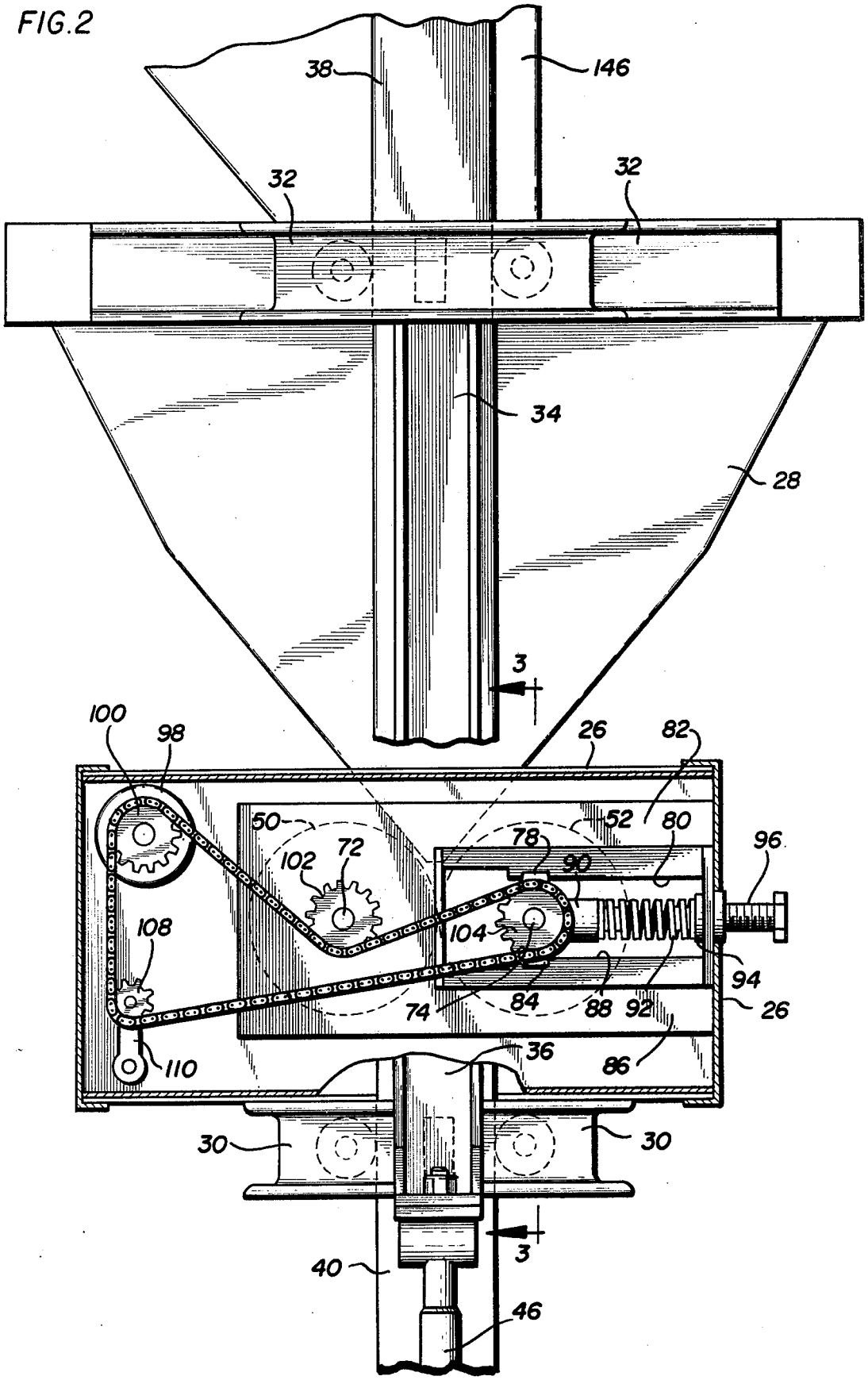
FIG. 2 is a side elevational view of the improved core cleaning material delivery unit, including a pair of counter-rotating rollers mounted side by side, and means for driving and maintaining the rollers in counter-rotating, rotational engagement.

Core cleaning material delivery unit 12 is vertically adjustable by means of a pair of hydraulic driven telescoping columns 46 each of which is mounted at one end to the lower frame member 30 and at the other end to slide within a rigid member 47. Well-known hydraulic drive means coupled to rigid members 47 and telescoping columns 46 are used for raising and lowering of the core cleaning material delivery unit 12 so as to vary the height of the falling shot/grit with respect to the sand cores 18. As shown in FIG. 2, a pair of respective upper and lower roller guides indicated in dashed lines as mounted in frame members 32 and 30, assist in maintaining and guiding the delivery unit 12 during vertical movement on the support columns 38 and 40.

Figure 3:
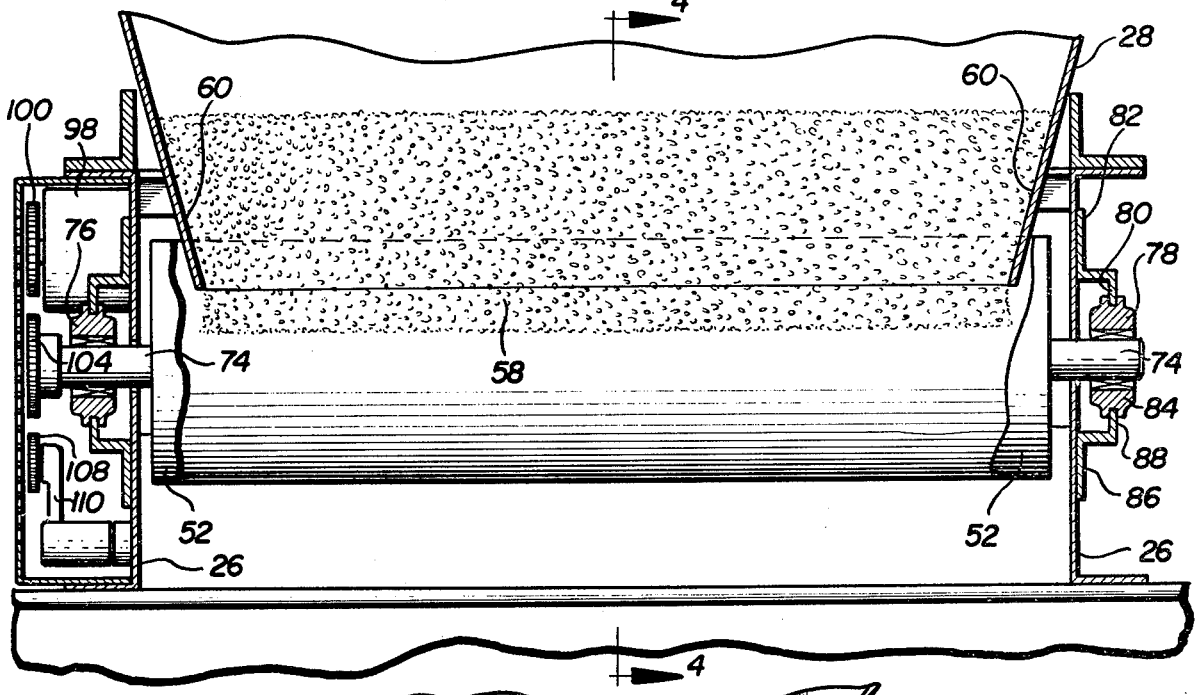
FIG. 3 is a front elevational view taken along section line 3—3 of FIG. 2, illustrating the feeding of metal grit between the rollers in the improved core cleaning material delivery unit of the present invention.
Figure 4:
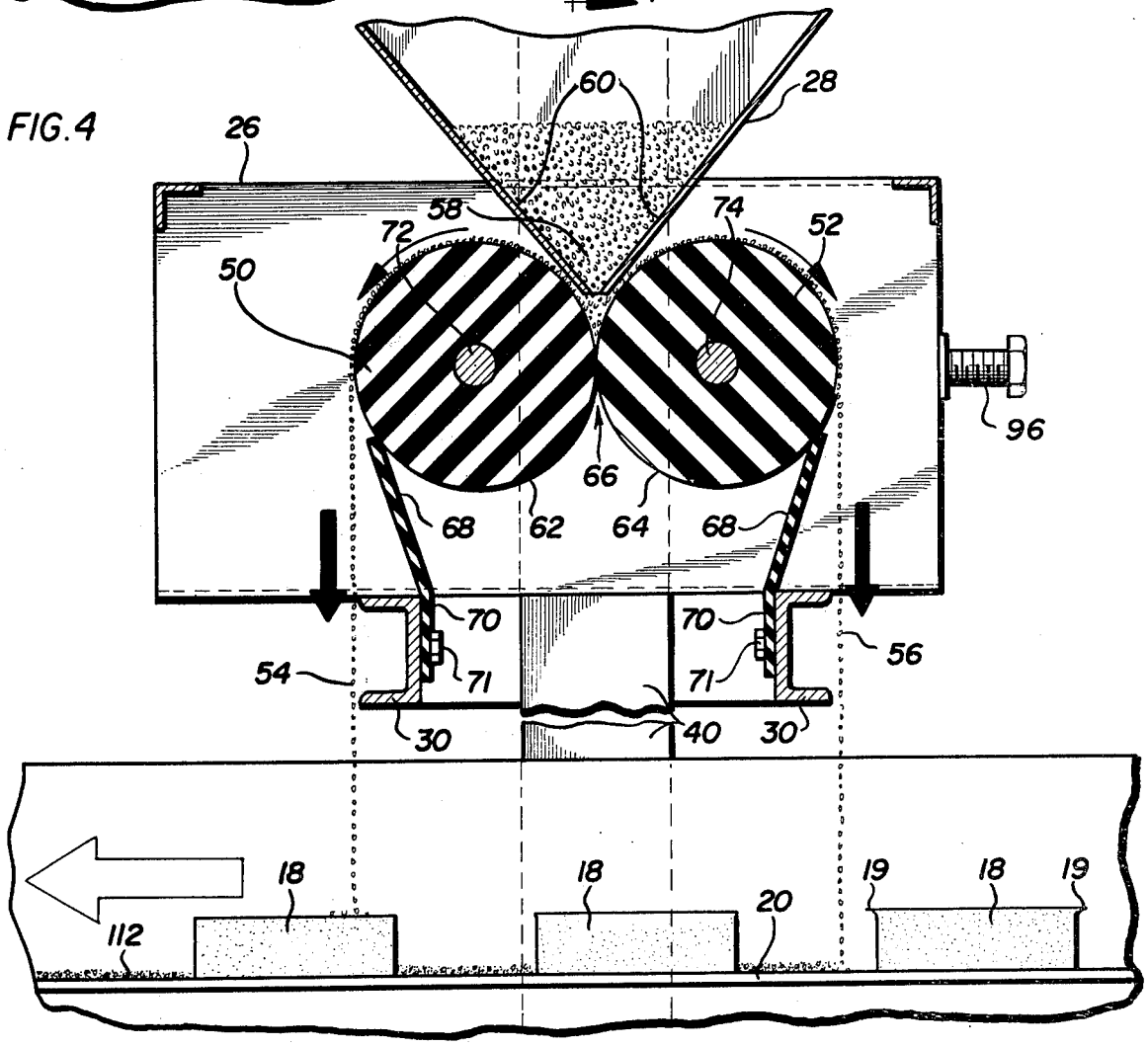
FIG. 4 is a side elevational view taken along section line 4—4 of FIG. 3, illustrating the feeding of the metal grit core cleaning material directly between the counter-rotating rollers and the delivery of the metal grit in a pair of falling curtains onto the sand cores for removal of fins.

Reference may now be made to FIGS. 2–4, wherein there is illustrated the construction details for an improved core cleaning material delivery unit 12. FIG. 4 illustrates the metal shot/grit delivery unit 12 including rollers 50 and 52 rotating in opposite directions to supply a double curtain of falling shot or grit 54 and 56 onto the cores 18 for removal of the fins 19. While the fins 19 in FIG. 4 are shown on the outside surfaces of the cores 18, it is understood that they can as well be located in the interior surfaces of the core and still be removed by the falling shot or grit curtains 54 and 56.

The core cleaning material such as metal grit 58 is guided by interior surfaces 60 of feed hopper 28 so as to place the grit 58 directly at the junction between the two rollers 50, 52. The roller surfaces 62 and 64 are formed of a resilient coating, such as rubber. This enables the grit fed to the top of junction 66 between the rollers to be carried upwardly by the rollers rotating away from the top of the junction and eventually fall as the curtains 54, 56. It may be noted that the exterior surfaces of the hopper 28 at the roller junction 66 act as a restricting surface tending to smooth out and thereby regulate the amount of grit carried upwardly by each of the rollers. A pair of angled wiper guards 68 associated with a respective roller each has one end 70 mounted to the lower frame member 30 by means of a suitable fastener 71. The opposite end of the wiper guards 68 rides on the respective roller surfaces 62 and 64 so as to wipe off any grit 58 which tends to cling to the roller surface. Wiper guards 68 also act as a safety shield to prevent the insertion of fingers between the rollers. The wiper guards 68 can be formed of a hard rubber or other such elastomeric material.

Each of the rollers 50 and 52 is mounted on a respective shaft 72 and 74. Shaft 72 is rotatably mounted in suitable bearings with the bearings in turn being rigidly mounted on opposite sides of the roller enclosure 26. With reference to FIG. 3, it can be seen that shaft 74, on the other hand, is rotatably mounted within respective end bearings 76 with the bearings 76 in turn being slidably mounted on opposite sides of the roller enclosure 26. A grooved upper portion 78 of the shaft bearing 76 slidably engages a leg extension 80 of upper bracket 82 which is welded or otherwise rigidly mounted to the roller enclosure 26. It can be seen from FIG. 3 that a similar slidable mounting arrangement is provided for the grooved lower portion 84 of bearing 76. In this case, lower bracket 86 is also welded or otherwise secured to the roller enclosure 26 and includes an upstanding leg extension 88 fitting within the grooved portion 84.

Each of the bearings 76 includes a short neck portion 90 (see FIG. 2) having one end of a spring 92 mounted therein. The other end of spring 92 is held within an adjustable stop 94. As can be seen in the sectional view of FIG. 2, the position of adjustable spring stop 94 can be threadably adjusted by means of the threaded screw 96. Therefore, the axis of roller 52 can slide in parallel movement towards and with respect to the axis of the fixed position roller 50 so that the roller surfaces 62 and 64 are maintained in contact at junction 66. By adjusting the threaded screw 66, more or less spring tension can be provided to urge the roller surfaces in more or less intimate contact. It is understood, of course, that the same slidable and adjustable spring tension is provided at each end of the roller shaft 74.

FIG. 2 illustrates the means for driving the fixed position roller 50 and the adjustable position roller 52 such that they rotate in opposite rotational directions with their respective surfaces in contact. A suitable motor 98 is mounted within enclosure 26 and drives gear 100. Gear 102 is mounted to the fixed rotatable shaft 72 of roller 50 and gear 104 is mounted to the positionable rotatable shaft 74 of roller 52. Drive chain 106 engages drive gear 100 and driven gears 102 and 104 so as to drivingly rotate the rollers 50 and 52 in opposite rotational directions as indicated by the reference arrows. Gear 108 engages the drive chain 106 and is suitably mounted on a positionable pivoting arm 110 within the enclosure 26 so as to take up any slack in the drive chain 106.

Referring now to FIG. 1, separator means 14 are provided at the core discharge end 24 of the core conveyor. The separator means 14 directs a generally horizontal airstream at a mixture 112 of fallen metal grit or shot 58 and loosened sand 114 resulting from removal of fins 19. The generally horizontal airstream is provided by coupling pressurized air to a pipe inlet 116 with the pipe extending between opposite sides of shroud 118 and having a series of orifices therein to allow the air to be directed towards the falling mixture 112. As can be seen from FIG. 1, the lighter weighted sand particles 114 are urged by the airstream into a sand receptacle 120 whereas the heavier weighted metal grit or shot 58 is relatively unaffected by the airstream and therefore falls generally vertically into a grit receptacle 122. Outlet 124 permits sand accumulated in the receptacle 120 to be withdrawn for further use. Similarly, accumulated grit in receptacle 122 may be withdrawn through outlet 126 for reuse as the core cleaning material.

The vacuum loader and particle separator 16 includes means for loading the separated metal grit particles 58 into the hopper 28, transferring the accumulated sand in receptacle 120 to another larger container, and providing pressurized air to pipe inlet 116. A vacuum source 128 mounted on frame 130 includes a suitable blower and one or more particle separator stages for separating particles from an airstream input 132 and directing the particles to a hopper 134 removably mounted on the frame 130. A commercially available unit suitable for use as a vacuum source 128 is available from NFE International, Ltd., the assignee herein, under the trademark HI-VAC and is described in U.S. Pat. No. 3,780,502.

The vacuum source 128 includes an outlet 136 supplying pressurized air which may be coupled through conduit 138 to the pipe inlet 116. A conduit 140 is coupled to the vacuum suction input 132 through a T-connector 142. The other end of conduit 140 is connected to a centrifugal unit 144 mounted atop a grit batch hopper 146, the hopper 146 being in turn rigidly mounted by suitable means to the support columns 38 and 40 so as to be aligned directly over the hopper 28. Conduit 148 interconnects the perimeter portion of centrifugal unit 144 with the input 126 to grit receptacle 122. Thus, suction on conduit 140 enables the grit in receptacle 122 to be transferred via conduit 148 into the centrifugal unit 144 and down into hopper 146. It is to be understood that the centrifugal unit 144 permits the grit to fall by its own weight into the hopper 146 whereas the suction airstream alone is drawn through the center of the unit 144 into conduit 140 in a well-known manner.

A pivoting counterweight 150 extending from a sealing plate 152 in cooperation with the negative pressure inside 146 is sufficient to overcome the weight of accumulated grit in the hopper 146 and thereby maintain a sealing condition for an opening 154 in the bottom of hopper 146. Equalization of the pressure inside hopper 146 permits the weight of accumulated metal grit therein to overcome the pivoting force of counterweight 150 so as to dump grit from the bottom of hopper 146 into hopper 28.

The suction input 132 of vacuum source 128 is also connected through T-connector 142, conduit 156 and an actuable control valve 158 to the outlet 124 of sand receptacle 120. Valve 158 is maintained in a normally closed condition so that suction is present in conduit 140 and sand particles 114 are allowed to accumulate in the receptacle 120. Valve 158 comprises a commercially available hydraulic or pneumatic unit which can be actuated either manually or by suitable timer control means 160. Thus, setting the timer control 160 for predetermined "on" and "off" intervals, valve 158 can be periodically opened so as to draw sand from receptacle 120 into the vacuum separator 128 for separation and depositing into the removable sand hopper 134. Opening of valve 158 also couples an atmospheric pressure condition to conduit 140 thereby equalizing the pressure inside and outside of hopper 146. This action permits the weight of the accumulated grit in hopper 146 to overcome the pivoting counterweight 150 to enable the accumulated grit to be dropped into hopper 28. Timer control 160 is set with suitable timing intervals to permit hopper 146 to dump the accumulated grit prior to being filled, and also to insure that hopper 28 never runs out of grit so that there is an uninterrupted flow in the grit curtains 54 and 56. Instead of the centrifugal unit 144 conduit 148 could be coupled into an impact separator to avoid bends in the conduits 140 and 148. A guiding chute can be mounted intermediate the bottom of hopper 146 and the hopper 28 to guide the grit as it is dumped.

The separator unit 14 and vacuum loader 16 thus enable the separation of grit and loosened sand, the periodic loading of hopper 28 for reuse of the grit, and the periodic emptying of sand receptacle 120. Metal grit 58 is a commercially available item consisting of angular, fine, flat, blast cleaning type metal particles. As an alternative, one may utilize commercially available metal shot consisting of substantially rounded balls having a diameter between about 1/32 inch to 3/32 inch. In any event, the metal grit or shot is readily conveyed by the rollers 50 and 52 into the falling curtains 54 and 56 of core cleaning material to remove the core fins 19.

It is to be understood that spring 92 not only functions to urge the respective roller surfaces into intimate contact thereby compensating for any wear in the roller surfaces, but also enables roller 52 to move away from roller 50 in the event large, foreign particles manage to find their way between the rollers. In this event, motor 98 is reversible so that drive chain 106 can be driven in the opposite direction to rotate rollers 50 and 52 opposite to their normal rotational direction and thereby purge the foreign particles from between the rollers.

If metal shot is used as the core cleaning material, the rollers may be rotated toward the top of junction 66 to provide a single shot curtain by passing directly between the rollers and exiting from the bottom of junction 66. It has been found that metal shot may be used in either the double curtain technique shown in FIG. 4 or in the above described single curtain. However, when using metal grit the double curtain of FIG. 4 is preferred.

In an alternative embodiment, the springs 92 could be elminated and the ends of roller shaft 74 then would be fixed in position after assuring that the roller surfaces 62 and 64 are in rotatable engagement. This double fixed roller embodiment might be preferred over the spring-tensioned, single roller embodiment previously described since many components, such as the sliding shaft bearings 78, 84, brackets 82, 86, neck portion 90, spring 92, etc. could be eliminated. Thus, this embodiment could be more economical to manufacture than the spring-tensioned embodiment.

The foregoing detailed description has been given for clearness of understanding only, and no unnecessary limitations should be understood therefrom as modifications will be obvious to those skilled in the art.

What is claimed is:

1. Apparatus for removing fins from sand cores using a core cleaning material comprising:

a frame;

a core conveyor mounted to said frame for transporting said sand cores during removal of said fins;

counter-rotating roller means mounted to said frame above said core conveyor for delivering a falling curtain of said core cleaning material onto said cores for removal of said fins, including, a pair of rotatably engaging rollers mounted to transversly extend substantially across said core conveyor and defining a contact surface junction;

means for feeding said core cleaning material above said contact surface junction; and means for rotating said rollers in opposite rotational directions, enabling said core cleaning material to be withdrawn from said contact surface junction and deposited as a falling curtain of core cleaning material onto said cores to substantially remove said fins.

2. Apparatus according to claim 1, including means for rotating said rollers in opposite rotational directions away from the top of said contact surface to withdraw said cleaning material upwardly over each of said rollers to form a double curtain of falling core cleaning material onto said cores.

3. Apparatus according to claim 1, including means for vertically moving said counter-rotating roller means to adjust the falling height of said core cleaning material onto said cores.

4. Apparatus according to claim 1, wherein said means for feeding said core cleaning material above said contact surface junction includes a hopper for said core cleaning material mounted above said rollers, said hopper having angled surfaces extending immediately above said junction to guide said core cleaning material thereto.

5. Apparatus according to claim 1, including roller shaft bearing means for positionally adjusting said rollers in intimate rotatable engagment to define said contact surface junction.

6. Apparatus according to claim 5, wherein said roller shaft bearing means includes spring tension means for urging said rollers into rotatable engagement.

7. Apparatus according to claim 1, including separator means for separating said core cleaning material from loosened sand resulting from removal of said fins, and loading means for receiving said separated core cleaning material from said separator means and directing said core cleaning material to said contact surface junction.

8. A core cleaning material delivery unit for use in removing fins from foundry sand cores comprising:

counter-rotating roller means for delivering a falling double curtain of said core cleaning material onto said cores for removal of said fins, including, a pair of rotatably engaging rollers defining a contact surface junction;

means for feeding said core cleaning material above said contact surface junction; and means for rotating said rollers in opposite rotational directions away from the top of said contact surface junction to withdraw core cleaning material from said contact surface junction and transport it upwardly over each roller for depositing it as a double curtain of falling core cleaning material onto said cores.

9. A core cleaning material delivery unit according to claim 8, including means for adjustably positioning said rollers with respect to each other to obtain their rotatable engagement defining said contact surface junction.

10. A core cleaning material delivery unit according to claim 9, including spring tensioning means for urging said rollers into rotatable engagement.

11. A core cleaning material delivery unit according to claim 8, including hopper means, including a hopper for containing said core cleaning material, for feeding said core cleaning material from the bottom of said hopper to said contact surface junction.

* * * * *

UNITED STATES PATENT AND TRADEMARK OFFICE

CERTIFICATE OF CORRECTION

PATENT NO. : 4,160,650

DATED : July 10, 1979

INVENTOR(S) : BRIAN J. JENSEN

It is certified that error appears in the above-identified patent and that said Letters Patent are hereby corrected as shown below:

Column 1, line 33, "893,203" should be --898,203--.

Signed and Sealed this

First Day of April 1980

[SEAL]

Attest:

SIDNEY A. DIAMOND

Attesting Officer

Commissioner of Patents and Trademarks